US006698473B2

(12) United States Patent
Decarne

(10) Patent No.: US 6,698,473 B2
(45) Date of Patent: Mar. 2, 2004

(54) CONE-SHAPED JET FILLING TUBE AND FILLING MACHINE EQUIPPED THEREWITH

(75) Inventor: Patrick Decarne, Le Havre Cedex (FR)

(73) Assignee: Sidel, Le Havre Cedex (FR)

( * ) Notice: Subject to any disclaimer, the term of this patent is extended or adjusted under 35 U.S.C. 154(b) by 0 days.

(21) Appl. No.: 10/343,100

(22) PCT Filed: Jul. 20, 2001

(86) PCT No.: PCT/FR01/02366

§ 371 (c)(1),
(2), (4) Date: Feb. 14, 2003

(87) PCT Pub. No.: WO02/14207

PCT Pub. Date: Feb. 21, 2002

(65) Prior Publication Data

US 2003/0150517 A1 Aug. 14, 2003

(30) Foreign Application Priority Data

Aug. 16, 2000 (FR) ..... 00 10642

(51) Int. Cl.[7] ..... B65B 31/00

(52) U.S. Cl. ..... 141/286; 141/7; 141/54; 141/70; 141/295

(58) Field of Search ..... 141/286, 7, 70, 141/295, 54, 63, 37; 239/290, 418, 423, 424, 434.5

(56) References Cited

U.S. PATENT DOCUMENTS

| | | | | |
|---|---|---|---|---|
| 1,170,672 A | * | 2/1916 | Adams | 141/58 |
| 2,605,949 A | * | 8/1952 | Stern | 141/39 |
| 3,460,590 A | * | 8/1969 | Robbins | 141/7 |
| 4,156,444 A | | 5/1979 | Mette | |
| 5,125,441 A | | 6/1992 | Mette | |

* cited by examiner

*Primary Examiner*—Gregory Huson
*Assistant Examiner*—Peter deVore
(74) *Attorney, Agent, or Firm*—Sughrue Mion, PLLC

(57) ABSTRACT

A filling tube for dispensing a liquid into a container, wherein the tube (10) includes an orifice (36, 40) for dispensing the liquid which conditions a cone-shaped jet, and wherein the tube includes an axial cannula provided with a gas discharge conduit (24) emerging inside the space defined by the cone-shaped jet. The cannula includes a gas intake pipe (28) which emerges inside the space defined by the cone-shaped jet and which sprays a gas stream which flows substantially parallel to the liquid cone-shaped jet, on the inner side thereof.

10 Claims, 1 Drawing Sheet

CONE-SHAPED JET FILLING TUBE AND FILLING MACHINE EQUIPPED THEREWITH

The invention relates to the area of filling spouts, in particular those intended for machines for filling bottles.

Making filling spouts that package a conical or "umbrella-shaped" jet of a product is already known. Used for filling bottles, they especially make it possible to do so such that the product will be projected very rapidly from the spout output against the internal side wall of the bottle. Thus, the product is introduced into the bottle by running along the internal wall and not by being projected directly to the bottom of the bottle. In this way, the bottle filling is carried out with as little foam formation as possible, which makes it possible to increase the filling rate and thus to decrease the time necessary for filling a bottle.

Arranging an axial hollow needle in such a spout type is also known, which makes it possible to evacuate the air initially contained in the bottle without disturbing the conical jet in any way.

Two examples of spouts designed in this way are found in the documents U.S. Pat. No. 4,156,444 and U.S. Pat. No. 5,125,441. These spouts make it possible to decrease, in a significant way, the filling times for a bottle even if the product being bottled is a carbonated liquid, such as sodas or beer or a liquid having a tendency to foam such as milk or fruit juice.

Another problem that can be encountered in the course of filling a bottle is that of contact of the product with ambient air. In fact numerous products, in particular beer and fruit juices, can be deteriorated by oxygen. Still in the course of filling with a spout of classic design, the product is greatly exposed to air. Thus the oxygen tends to incorporate into the product, which limits its storage time.

Thus the goal of the invention is to propose a new design for a filling spout which, while maintaining the qualities of the spouts described above, also makes it possible to greatly limit, or eliminate, contact of the bottled product with air.

In accordance with this goal, the invention proposes a filling spout for delivering a liquid into a container, of the type in which the spout comprises an orifice for delivery of the liquid which forms an umbrella jet and of the type in which the spout comprises an axial hollow needle equipped with an evacuation duct for gas which opens into the interior of the space surrounded by the umbrella jet, and which projects a flow of gas that flows essentially in parallel to the umbrella jet of the liquid, from the inside of same.

According to other characteristics of the invention:

- the gas supply duct opens into the interior of the space delimited by the umbrella jet in the form of an annular opening;
- at the level of its opening end, the gas supply duct comprises a deflecting surface that is essentially conical;
- the evacuation duct opens axially at the center of the annular opening of the gas supply duct, which opens axially at the center of the orifice for delivery of the product, which is essentially annular;
- the duct supply gas is supplied with a gas that is neutral with respect to the product to be delivered;
- the jet of product presents an axial rotation component;
- the spout comprises an annular chamber for causing rotation, in which the project is injected with a tangential speed component, the chamber for causing rotation being extended axially by an annular duct, of which the opening end forms the orifice for delivery of the product;

- the chamber for causing rotation is connected to the annular duct by a funnel-shaped surface;
- the axial hollow needle passes through the chamber for causing rotation axially;

The invention also relates to a machine for filling containers, characterized in that it comprises at least one filling station equipped with a filling spout that incorporates any one of the preceding characteristics.

Other characteristics and advantages of the invention will be seen from reading the detailed description that follows, as well as from viewing the attached drawings, in which.

Figure 1:
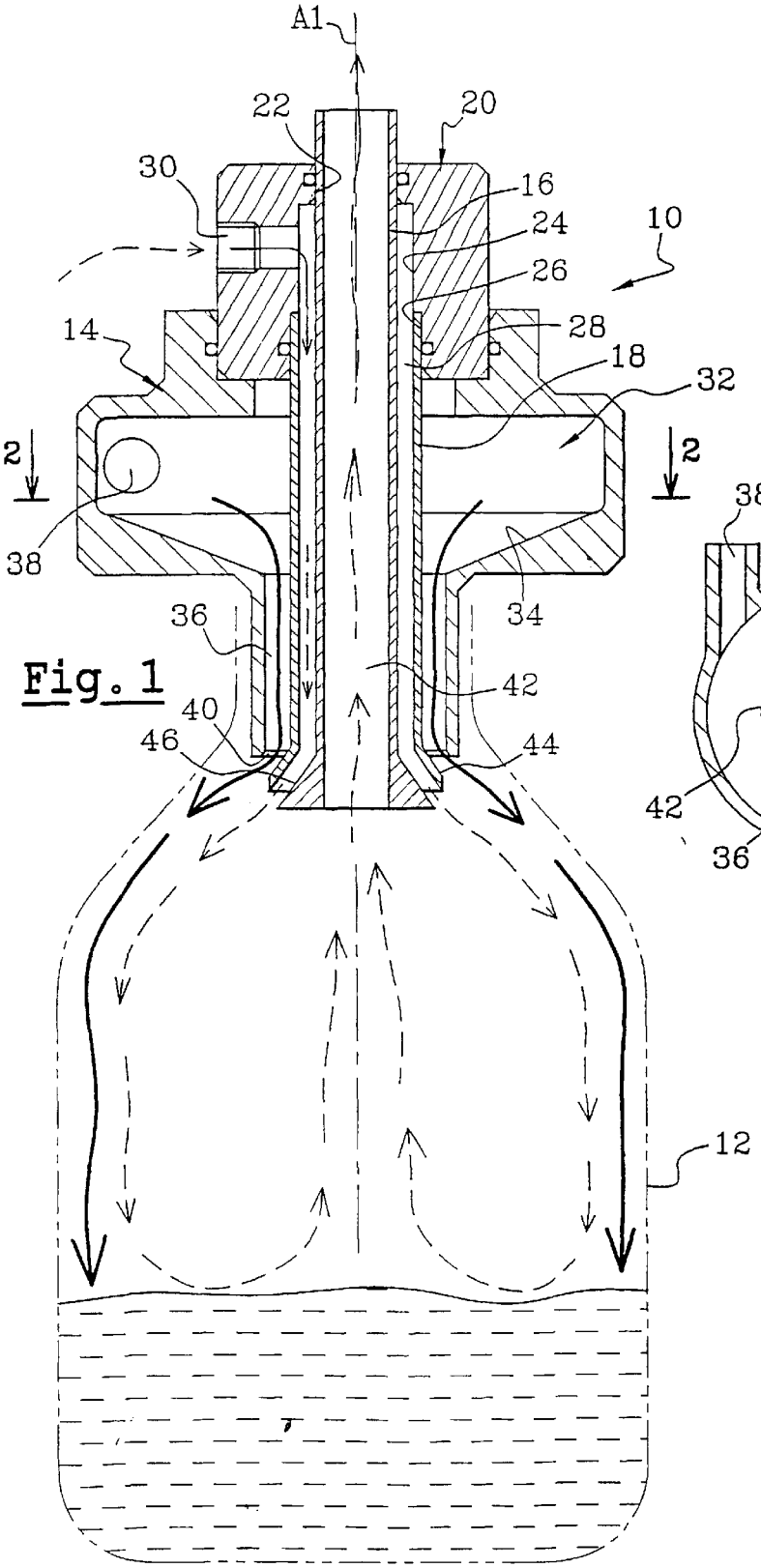
FIG. 1 is a schematic axial cross section view of a filling spout according to the instructions in the invention, the spout being illustrated in operation in the course of filling a bottle.
Figure 2:
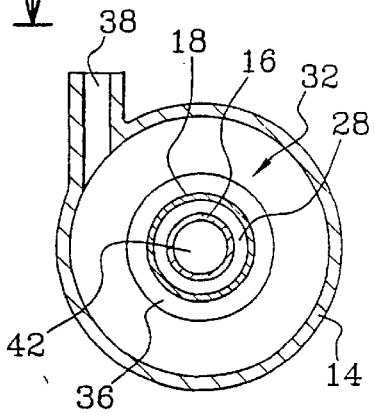
FIG. 2 is a reduced scale view in transverse cross section according to line 2–2 of FIG. 1.

The filling spout 10 illustrated in the figures is most particularly intended for filling bottles 12 with narrow necks. For example, it could be used equally well for glass bottles or bottles of plastic material such as terephthalic polyethylene (PET). Naturally such a spout will preferably be used for manufacturing filling machines with multiple spouts, for example of the rotating carousel type.

The terms for orientation such as "high," "low," "upper," "lower," etc. that are used for the description of the figures correspond to the example illustrated and must not be interpreted as being limitations to the scope of the invention.

Spout 10 illustrated on the figures essentially contains a main hollow body 14, essentially with revolution around axis A1, which has two coaxial tubes, an internal tube 16 and an external tube 18, passing through all of it axially.

The main body 14 thus delimits an internal volume with tubes 16, 18 passing through it axially. The main body 14, which is represented as a single piece, may also be made up of several pieces to facilitate manufacturing. An upper cover 20 which closes the internal volume in a sealed manner toward the top and which supports the tubes 16, 18, tops it.

The cover 20 has an internal borehole that passes through all of it, axially. The upper step 22 of the borehole, which opens toward the top toward the exterior of the main body, is cylindrical along axis A1 with essentially the same diameter as the external diameter of the internal tube 16.

The interior step 24, which opens out toward the top in the internal volume is cylindrical with axis A1, with essentially the same diameter as the external diameter of external tube 18.

The intermediate step 26, which extends axially between upper step 22 and lower step 24, is cylindrical with axis A1 and has essentially the same internal diameter as the external tube 18.

The upper end of the external tube 18 is engaged axially from the bottom to the top in the interior step 26 of the borehole in the cover, until it comes in contact with an annular abutment surface that delimits the lower step 24 of the intermediate step 26. The tube 18 is shown with locking and with the presence of a sealing ring in such a way as to insure, on one hand, the fastening of external tube 18 on cover 20, and on the other hand the sealing of this assembly.

Internal tube 16 is engaged, axially in the center of the external tube 18 in such a way as to completely cross the cover 20. The internal tube 20 is held with teeth across the upper step 22 of the borehole in the cover, which also insures the fastening of the internal tube 16.

As can be seen in the figures, the internal diameter of the external tube 18 is greater than the external diameter of the internal tube 16 in such a way that when they are mounted coaxially on cover 20, an annular space exists between the two tubes 16, 18 that forms a channel 28. As can be seen in FIG. 1, the upper end of this channel 28, which is formed by the intermediate step 26 of the bore hole in cover 20 is closed due to the fact of the sealed installation of the internal tube 16 in the upper step 22 of the bore hole.

However, an intake port 30 crosses the cover radially to open into the intermediate step 24 of the borehole and thus make it possible to bring the channel 28 into communication with a source of liquid.

The internal volume delimited by the main body 14 essentially has three parts: an upper chamber for causing rotation 32, an acceleration cone 34 and an annular delivery duct 36. The chamber for causing rotation 32 has the simple shape of a ring arranged around the external tube 18. A feed intake 38 makes it possible to introduce the product to be bottled into the chamber 32 according to an orientation that is not purely radial but which, on the contrary, exhibits a tangential component. Since the product is introduced into the chamber at a certain pressure, the product is pulled into a spiral circulation in the chamber, the same as the case where this pressure comes only from the flowing of the product due to gravity. If necessary, it is possible to also give the feed input 38 a slight inclination in the vertical direction.

The annular delivery duct 36, by which the product to be bottled runs toward the container 12, is formed around the lower part of the external tube 18. In the example of the embodiment illustrated, it is provided that this part of the spout 10 penetrates into the interior of the neck of the container to be filled, in such a way that the duct 36 has a diameter that is less than that of the rest of the main body 14. The duct 36 is delimited by a tubular cylindrical wall. To connect the chamber 32 to the duct 36, a connecting surface 34 is provided which, for purposes of simplicity, has been chosen as a tapered surface.

Naturally, the internal shapes of the main body 14 of spout 10 may be optimized, e.g. as illustrated in document U.S. Pat. No. 5,125,441, without going beyond the instructions in the invention by doing so.

As can be seen in FIG. 1, the lower end of the external tube 18 drops below the level of the lower end of the duct 36, thus delimiting an orifice 40 for output of the product, which is annular. In addition, the lower end of the external tube 18 flares radially toward the exterior in such a way that the external surface of the outside tube thus forms a deflector 44 which tends to project the product radially toward the external so that it comes in contact with the internal wall of the container, forming an umbrella jet.

The dimensions and the respective positions of the end of the external tube 18 and the end of the duct 36 are chosen such that the passage section of the output orifice 40 is relatively reduced, this being in order to allow retention of the liquid contained in the spout when the product supply is cut off. The maximum acceptable passage cross section necessary to avoid product leaking is determined, in particular, as a function of the intrinsic surface tension of the product.

In a comparable way, the lower end to the internal tube 16 extends axially below that of the external tube 18 and the external surface of the end of internal tube 16 flares radially toward the outside to form a deflection surface 46. The lower end of channel 28 is thus annular and flares radially toward the outside.

In function, the feed intake 38 of chamber 32 is connected to a storage tank of the product to be bottled, with a controlled valve mounted between. The opening and the closing of the valve can be controlled as a function of different parameters. It may be a time control that determines a fixed time period for filling which will be used for all containers. The control may be of the weight type, the delivery of the product being interrupted when the container has reached a predetermined weight. It may also be a matter of a feed control in which the rate of feed delivered by the spout is integrated in order to have an estimate of the volume of product poured into the container. In the case of a volumetric machine, the product quantity to be delivered will be measured into an intermediate volume placed between the storage tank and the filling spout.

The intake port 30 of channel 28 supplied with gas will preferably be connected to a source of gas that is neutral for the product under consideration. This neutral gas could be e.g. carbon dioxide ($CO_2$) or nitrogen ($N_2$).

Finally, the central duct 42 delimited by the inside of the central tube 16 will be connected to a gas evacuation device or very simply to the open air.

In operation, the flow of product that is injected into the body of the spout is thus put in rotation in chamber 32 which, in combination with the annular form of the output orifice 40 and with the form of the deflection surface 44, insures that the product is delivered by the spout in the form of an umbrella jet. Since the lower part of the spout is connected in the container or is in the immediate proximity of it, the product then comes in contact with the internal wall of the container and runs along it to fill the container. A flow is obtained that creates very little foam, even for high feed rates.

According to the invention, the channel 28 is supplied with a neutral gas in such a way that the flow of gas flowing through the lower end of the channel 28 opens out "below" the umbrella flow of the product. Because of the flared shape of the deflection surface 46, the gas flow runs essentially parallel to the flow of product into the bottle.

Thus, due to the invention, the flow of product is trapped, as it were, between the wall of the container on the outside and the flow of neutral gas on the inside. In this way, contact of the product with the ambient area is very limited, or even completely eliminated.

Naturally the evacuation duct 42 makes possible for the gas to escape from the container gradually as the product level increases in the container. This escape occurs preferably by way of the center of the container, toward the top of the long axis A1. The evaluated gases may be either a part of the gas initially contained in the container before filling, or a part of the neutral gas supplied by the duct 36.

To further limit the possibility of contact of the product with ambient air, it is possible to provide the beginning of the filling operation with a preliminary step of flushing the container with a neutral gas. The effectiveness of such a flushing with the spout according to the invention will be particularly improved by the specific outflow due to the spout. In fact, the flow injected by the duct supplied with gas 28 runs toward the bottom along the wall of the container and it goes back up along axis A1 in the direction of the evacuation duct 42. This outflow makes it possible to remove the air previously contained in the container in a very small amount of time and in a very efficient manner. Thus, without much increasing the total time necessary for filling a container, the contact of the product with air is diminished in a very significant way.

Due to the spout according to the invention, it is also possible to extend the injection of the neutral gas beyond the time necessary for filling the product, in order to complete the flushing of the space at the head of the container with a neutral gas to prevent capturing air in the bottle, thus in contact with the product, at the moment of sealing the bottle.

What is claimed is:

1. Filling spout for delivering a liquid into a container, of the type in which the spout (10) comprises a delivery orifice (36, 40) of the liquid which forms an umbrella jet, and of a type in which the spout has an axial hollow needle equipped with a gas duct (4) of which opens into the inside of the space delimited by the umbrella jet, characterized in that the hollow needle comprises a channel (28) supplied with gas that opens into the inside of the space delimited by the umbrella jet and which projects a flow of gas that runs essentially in parallel to the umbrella jet of the liquid, on the interior of same.

2. Filling spout according to claim 1, characterized in that the gas supply channel (28) opens out into the inside of the space delimited by an umbrella jet in the form of an annular opening.

3. Filling spout according to claim 2, characterized in that, at the level of its opening end, the gas supply channel (28) has a deflecting surface (46) that is essentially conical.

4. Filling spout according to claim 2, characterized in that the evacuation duct (42) opens out axially at the center of the annular opening of the gas supply channel (28), which opens out axially at the center of the product delivery orifice (36, 40), which is essentially annular.

5. Filling spout according to claim 1, characterized in that the gas supply channel is supplied with a gas that is neutral with respect to the product to be delivered.

6. Filling spout according to claim 1, characterized in that the product jet exhibits an axial rotation component.

7. Filling spout according to claim 6, characterized in that it comprises an annular chamber (32) for causing rotation in which the project is injected (38) with a tangential speed component, the chamber for causing rotation (32) being extended axially by an annular duct (36) of which the opening end forms the orifice (4) for delivery of the product.

8. Filling spout according to claim 7, characterized in that the chamber for causing rotation (32) is connected to the annular duct (36) by a funnel-shaped surface (34).

9. Filling spout according to claim 7, characterized in that the axial hollow needle (16, 18) passes through the chamber for causing rotation (32) axially.

10. Machine for filling containers, characterized in that it comprises at least one filling station equipped with a filling spout conforming to claim 1.

* * * * *